United States Patent [19]

Johnson et al.

[11] Patent Number: 4,902,300

[45] Date of Patent: Feb. 20, 1990

[54] SIMULTANEOUSLY DYED AND FLAME-RETARDED FABRIC BLENDS

[75] Inventors: James R. Johnson, McLeansville, N.C.; Randolph L. Finley, Florence, S.C.

[73] Assignee: Burlington Industries, Inc., Greensboro, N.C.

[21] Appl. No.: 195,858

[22] Filed: May 19, 1988

Related U.S. Application Data

[63] Continuation-in-part of Ser. No. 52,937, May 22, 1987, abandoned, which is a continuation-in-part of Ser. No. 870,892, Jun. 5, 1986, abandoned.

[51] Int. Cl.[4] ..... D06M 9/00

[52] U.S. Cl. ..... 8/532; 8/115.7; 8/127.1; 8/532; 8/584; 8/642

[58] Field of Search ..... 8/115.7, 127.1, 532, 8/584, 642; 252/608

[56] References Cited

U.S. PATENT DOCUMENTS

| | | | |
|---|---|---|---|
| 3,849,368 | 11/1974 | Anderson et al. | 260/45.8 R |
| 3,922,406 | 11/1975 | Chapin | 427/402 |
| 3,991,019 | 9/1976 | Shim | 521/55 |
| 4,066,812 | 1/1978 | Kaupin | 428/265 |
| 4,076,497 | 2/1978 | Freyberg | 8/532 |
| 4,078,101 | 3/1978 | Cole | 427/341 |
| 4,092,251 | 5/1978 | Smith | 252/608 |
| 4,160,051 | 7/1979 | Benisek | 427/352 |
| 4,657,558 | 4/1987 | Huxoll | 8/603 |
| 4,693,726 | 9/1987 | Meininger | 8/547 |
| 4,699,625 | 10/1987 | Jenkins | 8/532 |
| 4,732,789 | 3/1988 | Hauser | 427/393.3 |
| 4,750,911 | 6/1988 | Hansen | 8/584 |
| 4,752,300 | 6/1988 | Johnson | 8/584 |

FOREIGN PATENT DOCUMENTS

| | | |
|---|---|---|
| 0248553 | 9/1987 | European Pat. Off. . |
| 0249375 | 12/1987 | European Pat. Off. . |
| 2933207 | 4/1980 | Fed. Rep. of Germany . |
| 1531830 | 11/1978 | United Kingdom . |

OTHER PUBLICATIONS

Trotman, Dyeing and Chemical Technology of Textile Fibres, 6th ed., p. 245 (1984).

*American Dyestuff Reporter*, May 6, 1968, "A Study of Fire Retardancy of Polyester/Cotton Sheeting", pp. 40–44.

*Textiles*, vol. 98, 1983, p. 81.

*Primary Examiner*—John F. Niebling
*Assistant Examiner*—Isabelle Rodriguez
*Attorney, Agent, or Firm*—Nixon & Vanderhye

[57] ABSTRACT

Synthetic/cellulosic blend textile fabrics are simultaneously dyed and the synthetic component simultaneously treated to impart flame resistance in a single step with good color yield. Additional fabric finishing may be used to impart flame resistance to the cellulosic component of the fabric.

25 Claims, No Drawings

SIMULTANEOUSLY DYED AND FLAME-RETARDED FABRIC BLENDS

CROSS-REFERENCE TO RELATED APPLICATIONS

This application is a continuation-in-part of earlier application Ser. No. 052,937 filed May 22, 1987 which, in turn, is a continuation-in-part of Ser. No. 870,892 filed June 5, 1986, both now abandoned.

TECHNICAL FIELD OF THE INVENTION

This invention relates generally to dyeing and treating textile fabrics to impart flame resistance. Synthetic/-cellulosic blend textile fabrics are simultaneously dyed and the synthetic component flame retardant treated in a single step. Additional fabric finishing may be used to treat the cellulosic component of the fabric to impart flame resistance. In addition, fabrics composed entirely or predominantly of cellulosic fibers are treated to minimize shade change when flame-retardant treating with tetrakis-(hydroxymethyl) phosphonium salts.

Polyester/cellulosic blends are continuously dyed on a commercial scale according to conventional procedures with mixtures of disperse and vat dyes. The dyes are typically mixed with an antimigrating agent, a surfactant, a defoamer and a buffer. After the dye mix is padded and dried on the fabric, the treated fabric is heated to 204° C. to 218° C. to allow the disperse or polyester dyes to thermosol into the polyester fibers. The fabric is then cooled on cans and padded with a reducing bath containing sodium hydrosulfite and caustic, then steamed at slightly above atmospheric pressure at about 103° C., rinsed, and oxidized with hydrogen peroxide or sodium bromate to fix the vat dyes onto the cotton fibers. The dyed substrate is then scoured in hot water to remove any unfixed dyestuffs and auxiliary materials and finally dried, usually over several steam cans.

It is often desirable to impart flame resistance to fabrics, particularly synthetic/cellulosic blended fabrics, notably polyester/cotton and nylon/cotton blended fabrics. There are several flame retardants that can be thermosoled into dyed and undyed synthetic fibers. Cyclic phosphonate flame retardants, as exemplified by Antiblaze 19T (sometimes referred to herein for convenience as AB 19T, explained and identified in more detail below), appear to be among the most effective systems available commercially as flame retardant finishes for the synthetic components of such blends, the finish being applied by a pad/dry/thermosol process. The present inventors have recognized the possibility of incorporating not only the cyclic phosphonate flame retardant but also a suitable dye or mixture of dyes into the synthetic component of the blend to give the substrate some flame resistance, save the cost of an extra processing step and to produce a dyed fabric which has better properties.

It is an object of this invention to apply a flame retardant chemical for the synthetic fibers to a synthetic/cellulosic blend fabric during a continuous dyeing process in order to impart a significant level of flame resistance to the synthetic fiber of the blend, and thereby to produce a synthetic/cellulosic fabric with superior flame resistance. Another object of this invention is to provide a dyeing and flame retardant treating process in which the color yield is not significantly reduced by subsequent finishing operations, especially for fabrics predominantly of cellulosic or of all cellulosic fibers.

DETAILED DESCRIPTION OF THE INVENTION

This invention includes a process for simultaneously dyeing and imparting flame resistance to a synthetic/-cellulosic blend fabric containing at least 35% by weight synthetic, by (1) applying a dyebath containing a tinctorial amount of at least one dye for the synthetic fibers, a tinctorial amount of at least one dye for the cellulosic fibers, and a flame retarding amount of a cyclic phosphonate ester flame retardant to the synthetic/cellulosic blend fabric; (2) drying and heating the fabric to allow the synthetic dye and flame retardant to thermosol into the synthetic fibers, then (3) treating the fabric to fix the dye onto the cellulosic fibers; and finally (4) washing the fabric to remove any unfixed dye or components of the dyebath from the fabric. A final finishing step of applying a flame retardant finish to the cellulosic fibers has been shown to produce a flame resistant fabric with a Limiting Oxygen Index (LOI) of at least 27% after 50 and 100 home launderings, a soft handle suitable for use in apparel end uses, good wash and wear appearance performance, excellent strength and comfort characteristics, and good colorfastness performance.

This invention provides a process for dyeing synthetic/cotton fabrics and at the same time improving the flame resistance of the synthetic fiber. The flame retardant used is not limited to the cyclic phosphonates, which are presently preferred; other water-soluble high-boiling systems are expected to be suited to the process. Also, stable emulsions of water-insoluble systems should work if the total system is compatible with the dyestuffs and dyeing conditions.

The use of this method is not limited to synthetic/cellulosic blends. The method is also useful for 100% polyester, 100% cotton, 100% nylon, and other cotton and polyester blends. The process is also useful for minimizing shade change of all cellulosic (usually 100%) fabrics when THP salts are applied to them. As used in this specification and in the appended claims, the term synthetic thermoplastic fiber includes nylon or polyester. Cellulosic fibers include cotton, rayon, linen and blends thereof.

In finishing synthetic/cellulosic blends to impart flame resistance, the cellulosic and synthetic components should ideally be treated with specific chemicals to impart flame resistance to the individual fibers. Tetrakis-(hydroxymethyl) phosphonium salts (henceforth designated THP salts), such as THPS, are very effective for imparting flame resistance to cellulosic materials. This can be accomplished by using either a THP/urea precondensate salt, which is insolubilized with gaseous ammonia, or by using a THP/urea pad/dry/cure process, or both.

Cyclic phosphonates, as exemplified by Antiblaze 19T, are effective flame retardants for synthetic fibers. To maximize the favorable use of the cyclic phosphonate flame retardant and the dyeing operation, the synthetic fibers are treated with the flame retardant first; the cellulosic fibers are flame retardant treated during subsequent processing.

The cyclic phosphonate flame retardants are compatible with the dyebath and processing conditions conventionally used in the dyeing (only) of synthetic/cellulosic blends. Simultaneous application saves two complete processing steps in the production of flame resistant fabrics. Since the cyclic phosphonate flame retardants are high-boiling solvent-type materials and the normal dyestuffs are somewhat soluble in them, there is a minimum of migration of the dyestuff during the drying step. Depending upon the solubility of the dyestuff system being applied, the antimigrant chemicals can be eliminated from the formulation.

Demonstrated advantages of the invention include: improved dye yield of cotton vat dyes; treatment of the synthetic contributing to the overall flame resistance of the substrate; minimization of adverse shade change with subsequent cellulosic flame retardant chemical application; imparting a smoother appearance after dyeing to the fabric, particularly polyester/cotton fabric; improved shade control; and reduced washdown after multiple home launderings.

A wide range of vat dyes have been evaluated for use in the process of this invention and, as expected, it has been found that certain optimum dyes clearly perform better than others. Polyester dyes (generally disperse dyes) have also been evaluated on 65/35 polyester/cotton blends, and it has been found that a maximum dye yield is realized around 2% AB19T level in the bath. At a 5% level, the disperse dye yield is equal to that obtained when 3% alginate antimigrant is used. It has been found that as the concentration of the AB19T is increased to 15%, the dye yield is decreased; however, more phosphorus or AB19T is fixed in the polyester fiber as the concentration of the flame retardant is increased, as would be expected. This decrease in dye yield may be due to the presence of excess AB19T on the surface, causing the dyes to establish an equilibrium between the "excess" AB19T and the polyester fiber. This phenomenon is related to the distribution coefficient of the dyes between the AB19T phase and polyester. The amount of flame retardant applied to the fabric is based upon the amount of phosphorus to be retained in the fibers balanced against the dye yield desired. Similar results are observed with nylon/cotton blends.

Polyester/cellulosic blend fabrics containing at least 35% by weight polyester, balance cellulosic fibers (usually cotton), are a preferred class of fabrics for simultaneously dyeing and flame retardant treatment. Polyester contents in the 40 to 60% weight range are most effectively treated. Other fibers forming the balance of the blend may include linen, rayon or, preferably, cotton. Another class of blended fabrics are nylon/cellulosic blends with the nylon component representing 40%, often about half, of the blend, balance cellulosic fibers, again usually cotton.

The fabrics dyed and flame-retardant finished according to the invention can be in any desired stage of processing, e.g., they can be treated as woven or knit fabrics. One flame retardant process suitable only for cotton fibers which provides satisfactory and durable flame resistance, known as the PROBAN process, consists of treating the cotton fabric with a prepolymer of tetrakis-(hydroxymethyl) phosphonium salt and urea, followed by ammoniation (THP/urea-precondensate/ammonia). The PROBAN process, licensed by Albright & Wilson, is described in the following U.S. Pat. Nos. 4,078,101; 4,145,463; 4,311,855; and 4,494,951, all to Albright & Wilson, the disclosures of which are hereby incorporated by reference to the extent necessary to explain the THP salt/urea-precondensate process. See also U.S. Pat. No. 4,346,031 to Elgal et al. This process is considered effective and is widely promoted by at least two companies for imparting flame resistance to 100% cotton fabrics; it is not promoted or advertised for polyester/cotton blends or nylon/cotton blends.

The THP/urea-precondensate/ammonia process consists of applying a THP/urea-precondensate to cotton fabric and drying the fabric to about 10 to 15 wt. % of moisture. The cotton fabric is then exposed to gaseous ammonia. The precondensate is insolubilized by the ammonia. Fixation of the precondensate takes place mainly inside of the cotton fiber, thus imparting durability to multiple launderings.

The invention will now be illustrated with reference to the following examples in which all parts and percentages are by weight and temperatures reported in degrees Celsius. Some formulations are expressed on a weight per volume basis with g/l indicating grams per liter. The materials used are more fully described as follows:

Among the flame-retardant materials used in accordance with the present invention are thermally stable cyclic phosphonate esters prepared by reacting alkyl-halogen-free esters with a bicyclic phosphite. As a class, these cyclic phosphonate esters are represented by one of the formulas:

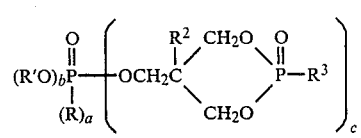

(A)

where a is 0 or 1; b is 0, 1 or 2, c is 1, 2 or 3 and a+b+c is 3; R and R′ are the same or different and are alkyl ($C_1$–$C_8$), phenyl, halophenyl, hydroxyphenyl, tolyl, xylyl, benzyl, phenethyl, hydroxyethyl, phenoxyethyl, or dibromophenoxymethyl; $R^2$ is alkyl ($C_1$–$C_4$); and $R^3$ is lower alkyl ($C_1$–$C_4$) or hydroxyalkyl ($C_1$–$C_4$) or

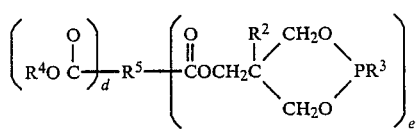

(B)

where d is 0, 1 or 2; e is 1, 2 or 3; $R^2$ is alkyl ($C_1$–$C_4$); $R^3$ is lower alkyl ($C_1$–$C_4$) or hydroxyalkyl ($C_1$–$C_4$); $R^4$ is alkyl ($C_1$–$C_4$) phenyl, halophenyl, hydroxyphenyl, hydroxyethyl, phenoxyethyl, dibromophenoxyethyl, tolyl, xylyl, benzyl, or phenethyl; and $R^5$ is monovalent alkyl ($C_1$–$C_6$), chlorophenyl, bromophenyl, dibromophenyl, tribromophenyl, hydroxyphenyl, naphthyl, tolyl, xylyl, benzyl, or phenethyl; divalent alkylene ($C_1$–$C_6$), vinylene, o-phenylene, m-phenylene, p-phenylene, tetrachlorophenylene (o, m, or p), or tetrabromophenylene (o, m, or p); or trivalent phenyl.

The preferred compounds (see below) are represented by the formula:

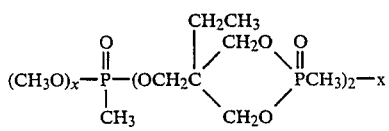

(C)

in which X is 0 or 1, and usually a 50:50 mixture of the mono- and di-esters. The preparation of these cyclic phosphonate esters and their use as flame retardants are described in U.S. Pat. Nos. 3,789,091 and 3,849,368, the disclosures of which are hereby incorporated by reference.

Antiblaze 19T, as described by the supplier Albright & Wilson, Inc., of Richmond, Virginia, is a cyclic phosphonate ester, available as an odorless viscous liquid (viscosity $1.30\times10^{-3}m^2/s$ at 40° C.) with a flashpoint of 171° C. (ASTM D-93).

Tetrakis-(hydroxymethyl)phosphonium sulfate (THPS), also available from Albright & Wilson, Inc., under the name of Retardol S and from American Cyanamid under the name Pyroset TKO, is a pale, straw-colored liquid that is miscible with water and has a pungent odor. Several related compounds can be used in place of THPS, including tetrakis-(hydroxymethyl)-phosphonium chloride (THPC), available under the name of Retardol C from Albright & Wilson, and tetrakis-(hydroxymethyl)phosphonium oxalate, available as Pyroset TKS from American Cyanamid Company.

THPS when mixed with urea and heated strongly forms a relatively insoluble polymer, containing both phosphorus and nitrogen, inside the cotton fibers, and around both the cotton and the nylon fibers. Insolubility of this polymer is increased further by oxidizing the phosphorus with hydrogen peroxide.

EXAMPLE 1

A 50/50 polyester/cotton 7 ounce 2×1 twill fabric was simultaneously dyed and the polyester fibers flame retardant treated using a disperse/vat dye formulation containing a flame retardant for the polyester fibers.

| | Concentration (g/l) |
|---|---|
| Dyestuffs in Pad Bath | |
| Polycron Dianix Blue FP (Disperse Blue 73) | 18.2 |
| Terasil Orange GFA (Disperse Orange 44) | 26.0 |
| Foron Rubine S-2GFL (Disperse Red 167:1) | 6.0 |
| Palanthrene Red LGG (Vat Red 32) | 3.0 |
| Cibanone Olive SP (Vat Black 23) | 44.0 |
| Carvat Brown BRS (Vat Brown 1) | 66.0 |
| Chemicals in Pad Bath | |
| Antiblaze 19T | 25.0 |
| Buffer N | 1.5 |
| Antimigrant B | 20.0 |

The fabric was padded with the above pad bath solution, squeezed to reduce wet pick-up, slowly dried using infrared predryers, and then totally dried prior to the thermosol step with steam cans. The treated fabric was heated to 216° C. in a gas oven for 60 seconds (1.37 m/s) to diffuse the color into the polyester fibers with dry heat (thermosoling). The vat dye was reduced by application of a sodium hydrosulfite/caustic solution after which the fabric passed through a 73-meter steamer. The excess dye was removed in two open wash boxes and the remaining vat dyes were fixed by oxidation using sodium bromate. The final shade was developed by soaping through four washboxes at 71° C.

EXAMPLE 2

A series of samples of 254 $g/m^2$ 65/35 polyester/cotton fabric was dyed by the method of Example 1, using varying concentrations of Antiblaze 19T to examine the effect on the dye yield. For purposes of comparison, a control fabric was dyed in a bath containing 20 g/l (grams/liter) of Antimigrant B, an alginate antimigrant, but no Antiblaze 19T. All of the dyebaths contained 2.0 g/l Buffer N. The dyes used in the bath were as follows:

| Dyestuff | Concentration (g/l) |
|---|---|
| Foron Navy Blue S-2GRL 100 Pst. (Disperse Blue 79) | 24.00 |
| Intrasil Orange YBLH 50% Liq. (Disperse Orange 29) | 5.50 |
| Foron Brilliant Yellow S-7GL 50% Pst. | 0.85 |
| Palanthrene Navy Blue Coll. Liq. (Vat Blue 16) | 18.21 |
| Cibanone Yellow 2GNP (Vat Yellow 33) | 0.31 |
| Patcovat Black SNAP (Vat Black 16) | 35.02 |

Table I shows the results of color measurements made on a series of six samples. The first fabric, the control, was dyed in a bath containing 20 g/l of Antimigrant B, but no Antiblaze 19T. The remaining five samples contained from 25 to 150 g/l of Antiblaze 19T. Color measurements made under CWF-10° Conditions (cool White Fluorescent illumination, 10° observer) are also presented in Table I.

TABLE I

Effect of Flame Retardant Concentration in Dyebath on Color Yield

| | Antimigrant B g/l | Antiblaze 19T g/l | Strength (KSSUM) | L* | C* | H* |
|---|---|---|---|---|---|---|
| Control | 20.0 | 0 | Standard | | | |
| 1 | 0 | 25 | 6.8% strong | −0.78 | −1.18 | 0.41 Red |
| 2 | 0 | 50 | 1.4% strong | −0.21 | 0.36 | 0.32 Red |
| 3 | 0 | 75 | 2.4% weak | 0.23 | 1.54 | 0.26 Red |
| 4 | 0 | 100 | 1.8% weak | 0.17 | 1.32 | 0.23 Red |
| 5 | 0 | 150 | 13.9% weak | 1.77 | 1.66 | −0.19 Green |

Table I measures color yield by KSSUM values, KSSUM representing an integrated measure of color strength over a range of wavelengths. The values for $\Delta L^*$ measure lightness, a lower number indicating a darker shade or a higher yield. $\Delta C^*$ is a measure of chroma, or brightness, and $\Delta H^*$ is a measure of hue. The shifts of chroma and hue are relatively small, confirming that changes of KSSUM or $\Delta L^*$ can be taken at face value.

As shown by Table I, the use of 25 g/l Antiblaze 19T in the bath produced a significant increase in yield, compared with the control, since the KSSUM value increased and $\Delta L^*$ decreased. The use of a very large quantity of Antiblaze 19T in the dyebath (150 g/l) produced the opposite effect, while the intermediate concentrations produced only small changes.

EXAMPLE 3

To assess the effect of AB19T on vat dye color yield, several pure vat dyes were applied to a 100% cotton fabric. Subsequent finishing of these fabrics with THPS/urea demonstrated that shade change was better controlled with the AB19 treatment than without. All fabrics were dyed in baths containing 30 g/l of dye and 50 g/l of AB19T. The wet pickup was 65%. Fabrics were also dyed with 30 g/l of an alginate antimigrant to act as a control fabric. Each of these fabrics was finished with an 18% owf add-on of a tetrakis-(hydroxymethyl)phosphonium sulfate/urea system and the impact on shade change was assessed. The results are presented in Table II.

In some instances, the nature of the THPS/urea and/or AB19T chemistry does not provide a compatible environment for the vat dye, resulting in possible destruction of the chromophore. Those examples are not cited. Color yield even with the THPS finish is maintained in some instances and not significantly reduced, at least to an unacceptable level, in other instances. As can be seen from Table II, the strength of dyeing as indicated by the strength values is significantly greater for those samples dyed in the presence of Antiblaze 19T than for the corresponding controls.

-continued

| Dyestuff | Concentration (g/l) |
|---|---|
| Buffer N | 1.5 |

The fabric was padded with the above solution to a 65% wpu, slowly dried with infrared predryers to minimize dye migration, totally dried on dry cans, and heated to a temperature of 216° C. for 60 seconds to allow the disperse dyes and Antiblaze 19T to diffuse into the polyester fibers. The reactive dye was fixed to the cotton by applying a soda ash/salt brine to activate the reactive dyestuff when passed through a 73-meter steamer. The excess dye was removed by passing the fabric through wash boxes at 82° C. In subsequent operations, tetrakis-(hydroxymethyl) phosphonium salts were applied to the substrate to provide an initial phosphorus content after oxidation of 3.0–3.2%. The fabric was compressively shrunk by methods well established in the trade to soften the handle.

The fabric was tested in accordance with NEPA 1975

TABLE II

Effect of Antiblaze 19T on Color Yield of Vat-Dyed Cotton

| | 50 g/l Antiblaze 19T | | | | 30 g/l Alginate THPS Finished | | | | 50 g/l Antiblaze 19T THPS Finished | | | |
|---|---|---|---|---|---|---|---|---|---|---|---|---|
| Dyestuff | Strength | ΔL* | ΔC* | ΔH* | Strength | ΔL* | ΔC* | ΔH* | Strength | ΔL* | ΔC* | ΔH* |
| lanthrene Brill. Red LGG Coll. Liq. (Vat Red 32) | 39.9% | −3.24 | 3.48 | −1.07 Red | −1.93% | 0.14 | 0.69 | −1.07 Red | 39.3% | −3.19 | 4.65 | −1.10 Red |
| tcovat Olive Ar Dbl. Pst. | 10.0% | −1.34 | 0.45 | −0.11 Red | −15.6% | 2.71 | 0.39 | 1.84 Gr | −1.6% | 0.46 | 0.69 | 1.96 Gr |
| lanthrene Blue CLF Coll. (Vat Blue 66) | 16.7% | −1.98 | 2.35 | 0.36 Red | −9.29% | 1.27 | −2.16 | −0.48 Gr | 6.28% | −0.81 | 0.42 | −0.01 |
| banone Yellow 2GN 8% Pst. (Vat Yellow 33) | 31.5% | −0.92 | 4.67 | 0.01 | 10.9% | −1.15 | 1.00 | −0.11 Red | 16.9% | 0.34 | −3.32 | −0.28 |
| lanthrene Brill. Green FFB (Vat Green 1) | 20.8% | −1.86 | 2.44 | −0.17 Yel | −12.0% | 1.62 | −0.39 | 1.49 Bl | 21.16% | −1.65 | 3.05 | 0.97 |
| banone Black SNA Dbl. Pst. (Vat Black 16) | 37.3% | −4.09 | −1.20 | 0.58 Red | −0.2% | −0.19 | 0.30 | 1.50 Red | 18.6% | −2.46 | 0.06 | 1.83 |
| ndothrene Grey NJB Pst. | 64.4% | −7.40 | 0.45 | −0.09 | −4.4% | 0.72 | 0.42 | −0.25 Red | 47.6% | −5.75 | 0.86 | −0.18 |
| banone Olive S Pst. (Vat Black 25) | 2.7% | −0.17 | 1.07 | −0.11 | −19.0% | 3.27 | 0.56 | −0.04 | −2.4% | 0.69 | 1.50 | 0.15 |
| rvat Brown BSQ Pst. (Vat Brown 1) | 49.0% | −5.31 | 2.49 | 0.24 | −8.4% | 1.34 | −0.42 | 0.85 Yel | 31.0% | −3.40 | 2.09 | 1.25 |

EXAMPLE 4

A 50/50 polyester/cotton 271 g/m² 2×1 twill fabric was simultaneously dyed and the polyester fibers flame retardant treated using a disperse/reactive dye formulation containing a cyclic phosphonate flame retardant for the polyester fibers. The dye formulation was as follows:

| Dyestuff | Concentration (g/l) |
|---|---|
| Terasil Yellow E6GSLW (Disperse Yellow 88) | 8.0 |
| Cibacron Yellow 6GP (Reactive Yellow 95) | 30.0 |
| Auxiliaries | |
| Antiblaze 19T | 25.0 |
| Antimigrant B | 20.0 |

Recommendations and the results reported in the following Table. Fabric produced by this method has excellent colorfastness, strength, wash and wear, and handle characteristics suitable for apparel use in the uniform market.

TABLE III

| Test Description | Test Method | Bottom Weight Twill |
|---|---|---|
| Weight (g/m²) | ASTM D-3776 | 268 |
| Tensile Strength (kg) | ASTM D-1682 | 66.7 × 41.7 |
| Tear Strength (kg) | ASTM D-1424 | 3.5 × 3.1 |
| Shrinkage (5 launderings) % | AATCC 135,3,IIB | 2.1 × 0.9 |
| Seam Efficiency (%) | FMT 5110 | 100 × 76 |
| Random Tumble Pilling (60 min) | ASTM D-3512 | 3.06 |
| Flex Abrasion, cycles | | 5500 × 4700 |
| Wash and Wear Appearance | | 3.60 |

TABLE III-continued

| Test Description | Test Method | Bottom Weight Twill |
|---|---|---|
| Air Permeability ($m^3/s \cdot m^2$) | 5450 | 0.107 |
| Moisture Vapor Transport, $g/m^2/24$ hrs. | | 680 |
| Moisture Regain (%) | | 5.3 |
| Resistivity | | |
| 65% RH | | $1.0 \times 10^{12}$ |
| 40% | | $3.6 \times 10^{13}$ |
| Colorfastness | | |
| Laundering IIA (staining) | AATCC 61-IIA (120-F) | 4.5 |
| Crocking - Dry | AATCC-8 | 4.5 |
| - Wet | | 4.0 |
| Light | AATCC 16A | 4.0 |
| Flame Resistance Testing | FTM-191-5903* | |
| Original Char length (cm) | | 10.2 × 8.9 |
| Afterflame (sec) | | 0 × 0 |
| Afterglow (sec) | | 0 × 0 |
| 50 × - Char length (cm) | | 10.4 × 9.7 |
| Afterflame (sec) | | 0 × 0 |
| Afterglow (sec) | | 0 × 0 |
| 100 × - Char length (cm) | | 11.9 × 11.4 |
| Afterflame (sec) | | 0 × 0 |
| Afterglow (sec) | | 0 × 0 |
| Melt/Burn Resistance | NFPA-1971 | Pass |
| Shrinkage | NFPA-1971 | 1.0% |
| Limiting Oxygen Index (%) | ASTM D-2863 | |
| Unlaundered | | 27.5 |
| After 50 laund. | | 27.2 |
| after 100 laund. | | 27.3 |

*These results are typical of those achieved on production lot

What is claimed is:

1. A process for simultaneously dyeing and imparting flame resistance to a polyester/cellulosic blend fabric, containing at least 35% by weight polyester, comprising the successive steps of:

(1) applying a dyebath containing a tinctorial amount of at least one dye for the polyester fibers, a tinctorial amount of at least one dye for the cellulosic fibers, and a flame retarding amount of a cyclic phosphonate ester flame retardant to the polyester/cellulosic blend fabric;

(2) drying the fabric and heating the fabric to allow the polyester dye and flame retardant to thermosol into the polyester fibers;

(3) treating the fabric to fix the dye on to the cellulosic fibers; and (4) washing the fabric to remove any unfixed dye or components of the dyebath from the fabric.

2. The process of claim 1 in which the cellulosic component of the blend is linen, rayon, cotton, or mixtures thereof.

3. The process of claim 2 in which the cellulosic component is cotton.

4. The process of claim 1 in which the blend contains at least 50% polyester.

5. The process of claim 1 in which the blend contains from about 35% to about 65% by weight polyester.

6. The process of claim 1 in which the cyclic phosphonate ester is represented by the formula:

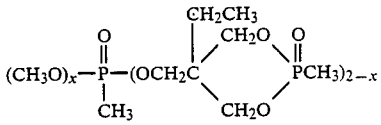

in which x is 0 or 1.

7. The process of claim 6 is which from about 1% to about 25% w/v phosphonate ester is present in the dyebath.

8. The process of claim 1 in which the dyebath also contains a wetting agent and an antimigrant.

9. The process of claim 1 in which a disperse dye is present for the polyester component and a vat dye is present for the cellulosic component.

10. A process for simultaneously dyeing and imparting flame resistance to a polyester/cellulosic fabric, containing at least 35% by weight polyester, comprising the successive steps of:

(1) applying a dyebath containing a tinctorial amount of at least one dye for the polyester fibers and a tinctorial amount of at least one dye for the cellulosic fibers, and a flame retarding amount for the polyester fibers of a cyclic phosphonate ester flame retardant to the polyester/cellulosic blend fabric;

(2) drying the fabric and heating the fabric to allow the polyester dye and flame retardant to thermosol into the polyester fibers;

(3) treating the fabric to fix the dye onto the cellulosic fibers;

(4) washing the fabric to remove any unfixed dye or components of the dyebath from the fabric; and thereafter (5) applying a flame retardant amount for the cellulosic fibers of a tetrakis-(hydroxymethyl) phosphonium salt flame retardant to the fabric to provide an LOI value of at least 27.0% after 50 launderings at 49° C. to the fabric thus treated.

11. The process of claim 10 in which the flame retardant of step (5) is a prepolymer condensate of a tetrakis-(hydroxymethyl) phosphonium salt and urea which when exposed to ammonia forms an ammoniated prepolymer flame retardant network within the cellulosic fiber structure.

12. The process of claim 10 in which the flame retardant of step (5) is a tetrakis-(hydroxymethyl) phosphonium salt which when reacted with urea forms an insoluble phosphorus-containing polymer in and on the cellulosic fibers.

13. The process of claim 10 in which the flame retardant of step (5) is a tetrakis-(hydroxymethyl) phosphonium salt and urea.

14. The process of claim 11, 12 or 13 in which the tetrakis-(hydroxymethyl) phosphonium salt is the chloride, sulfate, oxalate or phosphate salt.

15. The process of claim 10 in which the cellulosic component of the blend is linen, rayon, cotton or mixtures thereof.

16. The process of claim 15 in which the cellulosic component is cotton.

17. The process of claim 10 in which the blend contains at least 50% polyester.

18. The process of claim 10 in which the blend contains from about 35% to about 65% by weight polyester.

19. The process of claim 10 in which the cyclic phosphonate ester is represented by the formula:

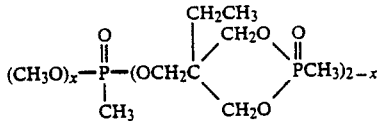

in which x is 0 or 1.

20. The process of claim 19 in which from about 1% to about 25% w/v of the cyclic phosphonate ester is present in the dyebath.

21. The process of claim 10 in which the dyebath also contains a wetting agent and an antimigrant.

22. The process of claim 10 in which a disperse dye is present for the polyester component and a vat dye is present for the cellulosic component.

23. A flame resistant polyester/cotton fabric containing between 40% and 65% of polyester, with Limiting Oxygen Index of at least 27% after 50 launderings at 120° F.

24. A flame-resistant polyester/cotton fabric containing between 40% and 65% of polyester, with a Limiting Oxygen Index of at least 27% after 100 launderings at 120° F.

25. A flame-resistant polyester/cotton fabric containing between 40% and 65% of polyester, which when tested in accordance wit FTM-191-5903 has a char length of less than 15.2 cm and afterglow and afterburn values of less than 1 second after 100 home launderings at 49° C.

* * * * *